US008746355B2

(12) United States Patent
Demmitt

(10) Patent No.: US 8,746,355 B2
(45) Date of Patent: Jun. 10, 2014

(54) FIRE EXTINGUISHING BOMB

(76) Inventor: Christopher Joseph Demmitt, Elkridge, MD (US)

( * ) Notice: Subject to any disclaimer, the term of this patent is extended or adjusted under 35 U.S.C. 154(b) by 306 days.

(21) Appl. No.: 13/309,925

(22) Filed: Dec. 2, 2011

(65) Prior Publication Data

US 2012/0138319 A1 Jun. 7, 2012

Related U.S. Application Data

(60) Provisional application No. 61/419,285, filed on Dec. 3, 2010.

(51) Int. Cl.

| | |
|---|---|
| ***A62C 35/02*** | (2006.01) |
| ***A62C 3/02*** | (2006.01) |
| ***A62C 8/00*** | (2006.01) |
| ***A62C 35/08*** | (2006.01) |
| ***F42B 12/50*** | (2006.01) |
| ***A62C 3/00*** | (2006.01) |
| ***A62C 37/00*** | (2006.01) |
| ***B05B 12/00*** | (2006.01) |
| ***F42B 5/145*** | (2006.01) |

(52) U.S. Cl.

CPC ..... *A62C 3/025* (2013.01); *A62C 8/005* (2013.01); *A62C 35/08* (2013.01); *F42B 12/50* (2013.01); *A62C 3/00* (2013.01); *A62C 37/00* (2013.01); *B05B 12/00* (2013.01); *F42B 5/145* (2013.01)

USPC ..... 169/26; 169/28; 169/35; 169/36; 169/54; 169/61; 169/70; 239/69; 102/369; 102/382

(58) Field of Classification Search

CPC ..... A62C 8/005; A62C 35/08; A62C 3/00; A62C 37/10; A62C 37/00; A62C 37/40; A62C 3/025; F42B 12/50; F42B 5/145; F42B 25/00; B64D 1/16

USPC ..... 169/35, 36, 26, 53, 54, 56, 60, 61, 70; 239/69, 171; 102/369, 370, 382, 383, 102/367

See application file for complete search history.

(56) References Cited

U.S. PATENT DOCUMENTS

| | | | | |
|---|---|---|---|---|
| 1,317,551 | A * | 9/1919 | Chambers | 102/365 |
| 2,703,527 | A | 3/1955 | Hansen | |
| 4,285,403 | A | 8/1981 | Poland | |
| 4,344,489 | A | 8/1982 | Bonaparte | |
| 4,964,469 | A | 10/1990 | Smith | |
| 6,318,473 | B1 | 11/2001 | Bartley et al. | |
| 7,089,862 | B1 | 8/2006 | Vasquez | |
| 7,261,165 | B1 | 8/2007 | Black | |

* cited by examiner

*Primary Examiner* — Steven J Ganey

(74) *Attorney, Agent, or Firm* — Ober, Kaler, Grimes & Shriver; Royal W. Craig

(57) ABSTRACT

A fire-extinguishing bomb that can be pre-programmed to explode 2-200 feet above the ground or tree line. The bomb employs a laser or barometric altitude sensor in combination with a GPS-altitude sensor for failsafe detonation with extreme accuracy at the proper altitude. The redundant fail-safe altitude-dependent detonation system ruptures a container carrying a payload of wet or dry fire retardant/suppressant, preferably dry environmentally-friendly fire-retardant powder having no toxicity and having fertilizer properties. Upon detonation the device coats the ground below with a uniform fire extinguishing coating. The core components of the bomb can be biodegradable, or alternatively can be readily retrieved and reused after each activation, thereby increasing both economy and reducing environmental concerns.

30 Claims, 3 Drawing Sheets

FIRE EXTINGUISHING BOMB

CROSS-REFERENCE TO RELATED APPLICATION(S)

The present invention derives priority from U.S. provisional application Ser. No. 61/419,285 filed 3 Dec. 2010.

BACKGROUND OF THE INVENTION

1. Field of the Invention

The present invention relates to fire extinguishing systems and, more particularly, to an environmentally-friendly fire extinguishing bomb for aerial deployment, and programmed explosive release of its contents.

2. Description of the Background

Large-scale forest fires are prevalent throughout the Midwest and Western states, and significant sums are spent on firefighting equipment. The conventional approach is aerial firefighting using fixed-wing aircraft and helicopters to drop chemicals such as water, foams, gels, or other specially formulated fire retardants. These chemicals are dropped from large air tankers with tanks that can be filled on the ground at an air tanker base. It has been reported that "The U.S. Forest Service and Bureau of Land Management own, tease, or contract for nearly 1,000 aircraft each fire season, with annual expenditures in excess of US$250 million in recent years. Borate salts were used in the past to fight wildfires but were found to sterilize the soil, kill animals, and are now prohibited. Newer retardants use ammonium sulfate or ammonium polyphosphate with a thickener. These are less toxic but still not environmentally friendly. Brand names of tire retardants for aerial application include Fire-Trol™ Phos-Chek™.

In addition to toxicity, there are serious questions about the effectiveness of airtankers.

The state of Victoria, Australia tested the effectiveness of a fleet of DC-10 Air Tankers during their wildfire season in 2009-2010, and concluded that these aircraft would not be effective in suppressing bushfires, especially in areas where the forest meets communities of relatively high populations. This was partly because the drop cloud released by the DC-10 is not uniform, but has thick and thin sections which leave areas on the ground with insufficient coverage. In addition, one drop impacted an Eucalyptus forest with such force that it broke off a number of trees with diameters of 4 to 10 inches. While the researchers did not have adequate equipment to accurately determine the drop height, it was thought that the aircraft was unintentionally flying too low and the retardant was still moving forward, rather than straight down, when it impacted the forest. Optimal dispersion without damage occurs when the drop is made straight down at 100-200 feet above the tree line, and this is difficult in an airplane. The government was also concerned that such drops have the potential to cause serious injury should the load fall on a person.

Rather than flying low and at slower speeds, an aircraft can drop an explosive payload from a higher altitude, and the concept of a fire extinguishing bomb for extinguishing forest fires is well known. For example, U.S. Pat. No. 4,344,489 to Bonaparte issued Aug. 17, 1982 shows a forest fire extinguishing projectile filled with an inert gas under pressure which is dropped into a fire and, upon impact, automatically disperses the gas.

U.S. Pat. No. 2,703,527 to Hansen issued Mar. 8, 1955 shows a similar fire-extinguishing bomb filled with fluid.

U.S. Pat. No. 6,318,473 to Bartley et al. issued Nov. 20, 2001 shows a fire extinguishing system including a sealed and explodable container with an explosive trigger for opening the sealed and explodable container to release the fire extinguishing agents. In use, the sealed and explodable container is placed at a base of the fire either by air dropping the container to the ground or by placing the container in the path of the fire, whereupon the container is opened with either an explosive device or by impact.

U.S. Pat. No. 4,964,469 to Smith issued Oct. 23, 1990 shows a device which, upon impact, will broadcast a dry material such as fire-suppressing chemicals by explosive force. The device includes an explosive charge within a frangible rigid-wall container, a dry powder payload, and a fuse cord that ignites upon impact.

U.S. Pat. No. 4,285,403 to Poland provides an explosive fire extinguisher that is designed to be dropped from an aircraft into fires such as forest fires. The device may be shock triggered on impact.

U.S. Pat. No. 7,261,165 to Black issued Aug. 28, 2007 shows a fire-extinguishing bomb with fire-smothering chemical and explosive charge is located inside a housing that is detonated when the housing unit impacts the ground.

U.S. Pat. No. 7,089,862 to Vasquez issued Aug. 15, 2006 shows a water pod that ruptures when dropped from an aircraft. The water pod may have a barometric activated explosive that is activated at a predetermined altitude.

Most of these prior art attempts rely on ground impact to release the fire retardant upon impact. Only the '862 patent to Vasquez suggests a water bomb with a timed-detonation or barometric activated explosive that is activated at a predetermined delay or altitude, but no design details are given, it is no easy task to design a barometric-activated fire-extinguishing bomb.

Consequently, there remains a need for an altitude-activated fire-extinguishing bomb that can be pre-programmed to explode at anywhere between 2-200 feet above the tree line, detonating with extreme accuracy and reliability at a preset altitude, and thereby disperse a fire suppressant or fire retardant fire retardant uniformly over a consistent area.

There is a further need for an altitude-activated fire-extinguishing bomb as above that is substantially biodegradable such that after detonation it presents no environmental problem, or one that can be readily recovered by a GPS locator and reused, thereby increasing economy and reducing environmental concerns.

SUMMARY OF THE INVENTION it is, therefore, an object of the present invention to provide a relatively inexpensive yet highly reliable and consistent altitude-activated fire-extinguishing bomb that can be pre-programmed to explode anywhere from 2-200 feet above the tree line.

It is another object to provide a fire extinguishing bomb that will detonate with extreme accuracy at the preset altitude, and which employs a failsafe detonation system.

It is another object to provide a barometric-activated fire-extinguishing bomb that uses a biodegradable cardboard shell and dry environmentally-friendly fire-retardant powder sealed in a plastic bag contained within the cardboard shell, the powder having no toxicity and having fertilizer properties. Alternatively, the powder could be replaced by a liquid with or without guar gum for sticking to leaves, the liquid likewise being sealed in a sealed plastic bag inside of the cardboard. The bomb contains an explosive device also sealed in a plastic bag or container.

It is still another object to provide an economical lase, GPS and/or barometric-activated fire-extinguishing bomb that can be recovered and reused after each activation, thereby increasing both economy and reducing environmental concerns.

In accordance with the foregoing object, the present invention is an altitude-activated fire-extinguishing bomb that can be pre-programmed to explode anywhere within a range of from 2-200 feet above the tree line. The bomb will detonate with extreme accuracy at the proper altitude, reliably due to a redundant failsafe altitude-dependent detonation sys thereby coating the ground below with a uniform coating of dry environmentally-friendly fire-retardant powder having no toxicity and also having fertilizer properties. In anon-reusable embodiment the shell of the bomb is constructed principally of cardboard and is likewise environmentally friendly. Alternatively, in a reusable embodiment the core components of the bomb can be readily retrieved and reused after each activation, thereby increasing both economy and reducing environmental concerns.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is an altitude-activated fire-extinguishing bomb that can be pre-programmed to explode anywhere within a range of 2-200 feet above the tree line, using a high-speed laser or barometric-altimeter detonation with reference to backup GPS data to ensure failsafe detonation. Upon mid-air detonation the fire-extinguishing bomb expels a fire suppressant or retardant, preferably a dry environmentally-friendly fire-retardant powder with no toxicity and fertilizer properties over a consistently-uniform area. The fire-extinguishing bomb payload may alternately be any suitable dry chemical agent such as Williams' "PKW™" which is a potassium bicarbonate based agent, or a liquid such as Halotron or water. Also Guar Guar (or other) gum can be added so the liquid will stick to leaves. The device can be used for both fire suppression and fire retarding.

Moreover, the altitude-activated fire-extinguishing bomb is substantially biodegradable cardboard and after detonation it presents no environmental problem. Alternatively, it can be readily recovered by a GPS locator and reused, thereby increasing economy and reducing environmental concerns.

Figure 1:
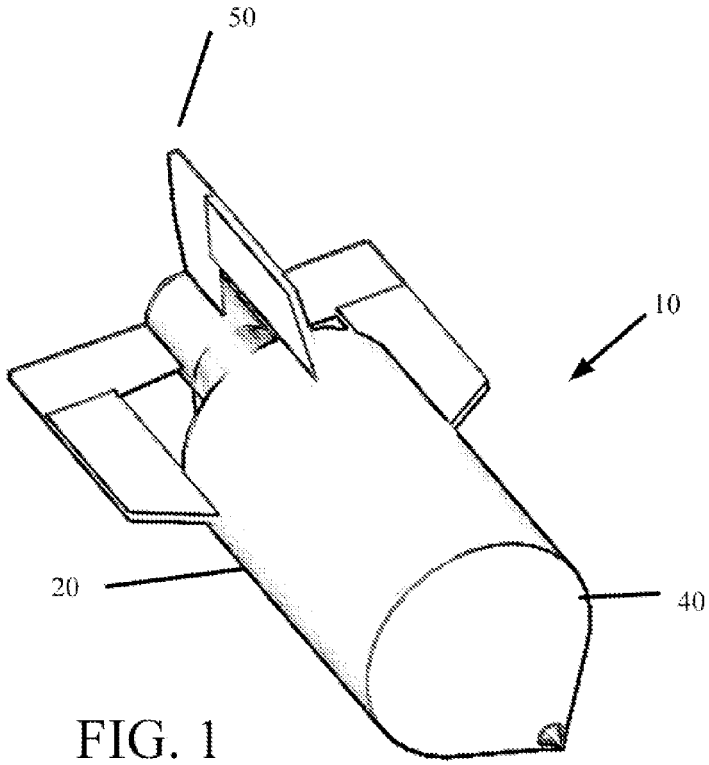
FIG. 1 is a perspective front view of a barometric-activated fire-extinguishing bomb 10 according to a preferred embodiment of the present invention.
Figure 2:
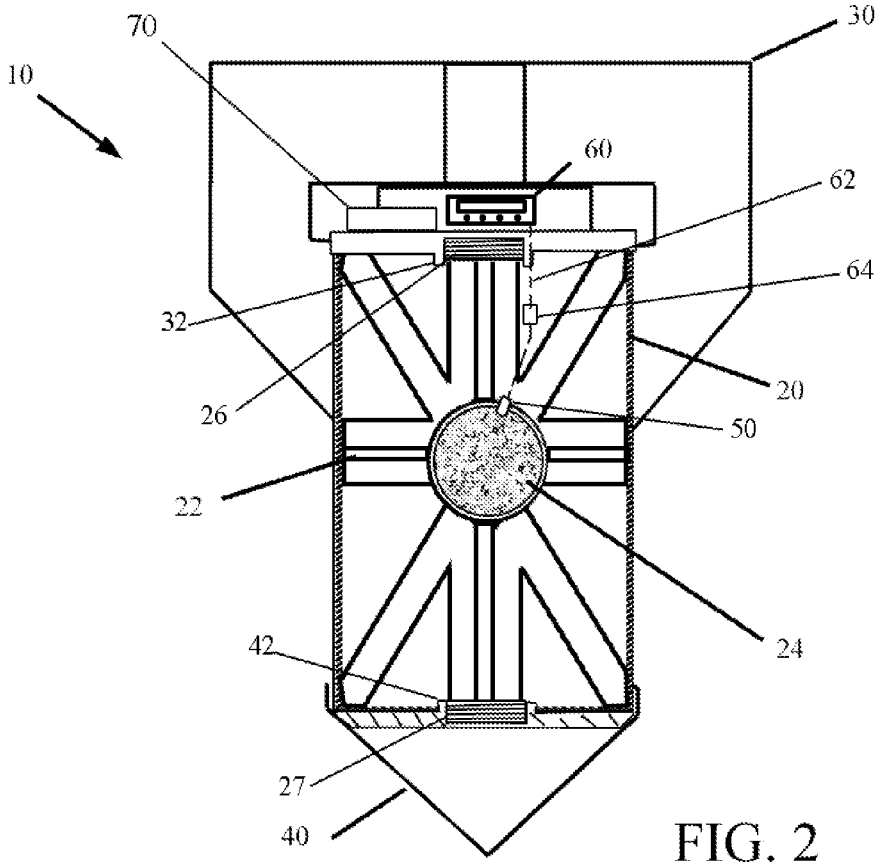
FIG. 2 is a side cross-section of the barometric-activated fire-extinguishing bomb 10 as in FIG. 1

FIG. 1 is a perspective front view of the barometric-activated fire-extinguishing bomb 10 according to the present invention. FIG. 2 is a side cross-section.

The bomb 10 generally includes a hollow cylindrical canister 20 formed of rupturable material, preferably corrugated cardboard or thin plastic. The cylindrical canister 20 is topped by an aerodynamic weighted tip 40 at one end, and a tail section 30 at the other end, both of which maintain a vertical trajectory. A programmable controller 60 is panel-mounted exteriorly on the tail section 30 or in some other place.

The bomb 10 may be dropped from a cargo airplane at speed or a stationery helicopter right over the target. The present invention is envisioned as being recoverable and reusable, or non-recoverable, depending on preference. In the latter case corrugated cardboard is preferred for its biodegradability, and with a laminated internal film liner if a liquid suppressant/retardant is to be used. For a recoverable/reusable variation, it is possible to use a conventional one-piece seamless 500 gallon (or larger or smaller) chemical storage drum rotationally-molded of UV-resistant low density polyethylene, with ¼" thick translucent wall for easy product level viewing. The polyethylene may be molded or score with seams to help ensure uniform rupture. In both cases dimensions are a matter of design choice, though exemplary dimensions are 46½" wide by 75" tall, with full 46" removable fill caps at each end. One skilled in the art will understand that canister 20 may be formed of any other suitable rupturable material including high density plastic, acrylic, high or low density plastic including PETG plastic, wood, fiberglass or any other suitable material.

As seen in FIG. 2, an internal framework 22 is inserted into the canister 20. The internal framework 22 is preferably a suitable three-dimensional structure for supporting and withstanding an explosive charge 24 at the center of canister 20 while it is filled with suppressant/retardant. The illustrated framework 22 comprises a series of ½' thick struts converging from the center of canister 20 outward to its inner walls, and leaving an open area at its center. The framework 22 is preferably made of Kevlar™ or other substantially explosion-proof material, and the struts are as thin (approximately ½") but wide (6-10") to securely cradle the explosive charge 24 without obstructing or absorbing the blast. The framework 22 has screw-threaded mounting collars 26, 27 at both ends both oriented along the axis of the canister 20 for mounting the cone-tip 40 and tail section 30.

The cone tip 40 is preferably weighted (e.g., water filled or otherwise) and may be a rupturable hollow closed cone with overhanging lip that fits over the canister 20, and attaches centrally thereto by screw-insertion of a screw-receptacle 42 onto screw-threaded mounting collar 27 of framework 22. The cone tip 40 is purely for weighting/aerodynamics in order to maintain a vertical orientation during free fall, and also serves to sandwich and center internal framework 22 within canister 20.

Similarly, tail section 30 is a screw-on cap bearing a threaded collar 32 that attaches onto screw-threaded mounting collar 26 of framework 22. The tail section 30 is also for aerodynamics and supports three or four radially-mounted foils around the periphery of the canister 20 for maintaining a vertical line in flight. The tails section 30 also serves to sandwich and center internal framework 22 within canister 20. In addition, tail section 30 provides a mounting for the controller 60 which is tucked in behind the canister 20. Programmable controller 60 has an on/off switch that serves as an activation control.

The controller 60 is connectable by internal wires 62 to a detonator 50 connected to an explosive charge 24 at the center of canister 20. The internal wires 62 are internally coupled by connector 64 so that the internal connection can be made prior to screw-coupling the tail section 30 to canister 20. One skilled in the art should understand that the internal wires 62 may be integrally molded into framework 22, and connector 64 may be anywhere along their length (otherwise than exactly as shown). Alternatively, wires 62 may be replaced with wireless capability such as radio frequency, Bluetooth or other known wireless protocols.

With the framework 22 inserted and cone-tip 40 mounted, the explosive charge 24 is inserted at the center of canister 20. The explosive charge 24 is packed with C4 or other suitable primary high explosive charge and has an integral detonator 50 inserted therein, C4 comprises explosives, plastic binder, plasticizer and trace chemicals. The explosive is RDX (cyclonite or cyclotrimethylene trinitramine), which makes up around 91% of C4 by weight. The size of explosive charge 24 is approximately one M112 demolition charge, which is approximately 33 cubic inches. C4 is preferred because it is very stable and insensitive to most physical shocks, and will not explode even when lit on fire. When the charge is detonated, the explosive is converted into gas. The gas exerts pressure in the form of a high velocity shock wave, which fragments the frangible canister 20 and disperses the MAP powder over a wide area. The detonator 50 is a commercially-available electric ignitor such as, for example, as sold by Mohawk Electrical Systems, Inc. of Milford, Del. The detonator 50 may be attached to and wired through framework 22 to programmable controller 60, and connector 64 may be provided anywhere along the wiring. Alternatively, detonator 50 may be in wireless communication with controller 60 via radio frequency, Bluetooth or other known wireless protocol.

The programmable controller 60 is a program able-altitude detonation control module with on-board or remote redundant altitude sensing circuit utilizing a primary altimeter and a GPS-based altimeter is redundant backup. The primary altimeter may be a laser line-of-sight distance measuring device, or a barometric pressure-measuring device as will be described.

Once set to explode at some variable distance above tree level (preferably 2-200 feet above the tree line or about 100-400 feet total), the programmable controller 60 will automatically detonate the explosive charge 24 at that precise altitude +/−10 feet. Moreover, if the higher-accuracy barometric or laser distance detector altimeter fails, the GPS-based altimeter serves as a failsafe backup for detonation.

Figure 3:
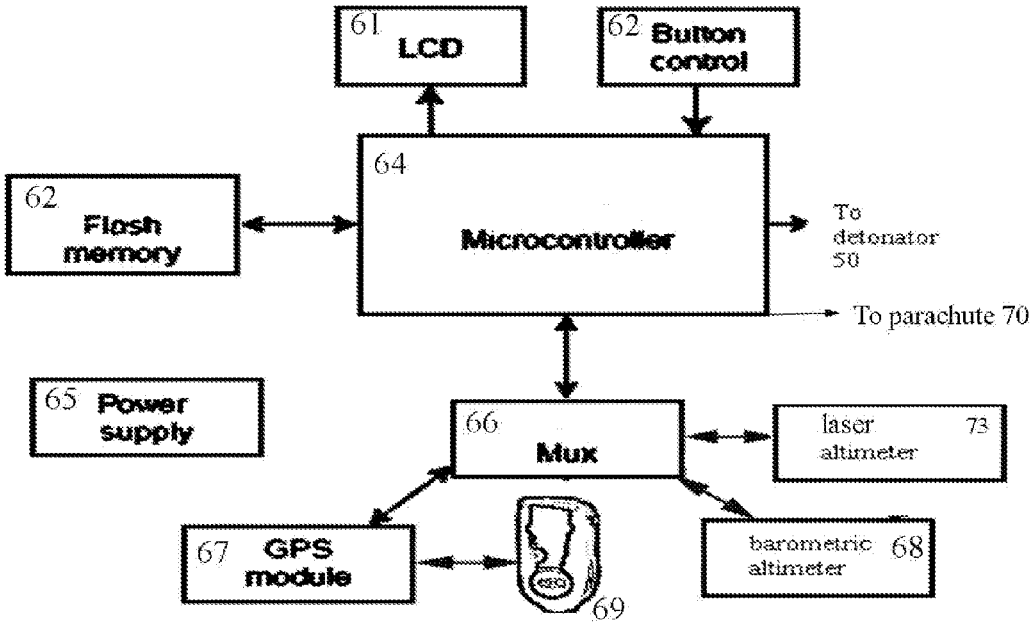
FIG. 3 is a block diagram of the programmable controller 60 of FIG. 2.

FIG. 3 is a block diagram of an embodiment of the programmable controller 60, which generally includes a conventional microcontroller 72 with peripheral flash memory 63, LCD display 61, control interface 71, all powered by a battery power supply 65. An "arm/disarm" control or ON/OFF switch applies power to the circuitry. If an "arm/disarm" control is provided, it may be a delayed-activation switch to ensure that the bomb 10 is falling before applying power to the circuitry. For example, the switch may be an air/wind-speed sensor that activates the circuitry when the bomb attains a predetermined airspeed. This way, if the wind speed hits for example, sixty miles per hour the switch then activates the circuitry. One skilled in the art should understand that any other suitable type of switch may be used. The microcontroller 72 is pre-programmed to alternately poll (through a multiplexer 66) a GPS module 67 for satellite position coordinates, and a barometric altimeter 68 for barometric altitude data. The barometric altimeter 68 is a high-accuracy altitude-sensing device as will be described and provides the primary altitude detonation data used by microcontroller 72 in activating the detonator 50. However, as a failsafe, the microcontroller 72 also periodically polls the GPS module 67 to confirm the data from the barometric altimeter 68, compares the data, and if the latter fails for any reasons the microcontroller 72 will as a failsafe rely on the GPS module 67 to detonate at a safe level. In accordance with the present invention, the microcontroller 72 polls both altitude data sources (the GPS module 67 and barometric altimeter 68) and keeps a dual-archive of both data streams in flash memory 63, monitoring both datasets to ensure a continuous log of decreasing altitude (as the bomb falls). With preference to the high-accuracy barometric altimeter 68, if the altitude dataset is interrupted for any reason microcontroller 72 will abandon its reliance and rely instead on the GPS data, ensuring detonation at a safe pre-programmed level. Logically, the microcontroller 72 is programmed to detonate at a predetermined level (for example, approximately 100-200 feet above tree level or 400-500 feet above ground level), and if the barometric altimeter 68 (or laser distance detector) fails, will default to detonate at 300-400 feet above ground level as measured by GPS module 67. Upon detonation the microcontroller 72 emits a signal to detonator 60 which explodes the C4 charge 24. At programmable time shortly before, simultaneous, or shortly after detonation the microcontroller 72 emits a signal to a deployable parachute 70, and so as detonator 60 explodes the C4 charge 24, a parachute 70 attached to the tail section 30 (see FIG. 2) unfurls. Parachute 70 is a conventional parachute except that it is fabricated from fireproof fabric. The exploding C4 charge 24 is calculated to blow apart the canister 20 and distribute its contents in a uniform pattern, which contents continue to disperse as they fall. Upon detonation the cone tip 40, tail section 30, ballistic internal framework 22, programmable controller 60 remain intact and fall softly to earth by parachute 70. As seen in FIG. 3, the GPS module 67 is connected to a conventional personal locator 69 also mounted in programmable controller 60 which emits a satellite beacon containing the GPS coordinates for easy recovery of the component parts.

Figure 4:
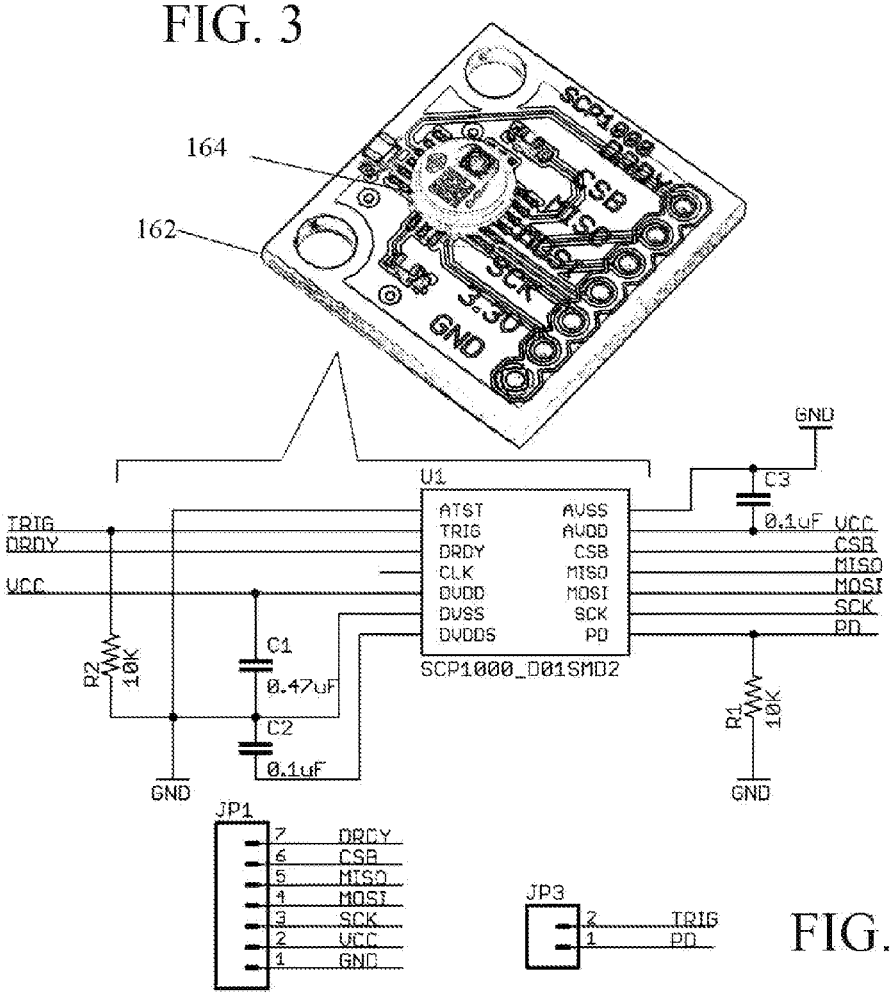
FIG. 4 is a circuit diagram of the barometric altimeter 68.

As seen in the circuit diagram of FIG. 4, an embodiment of a suitable barometric altimeter 68 is shown, which is a high-accuracy low-cost alti-variometer utilizing a VTI™ SCP1000 absolute pressure sensor circuit board 162, which in turn incorporates a Bosch BMP085 digital pressure sensor 164 and an on-chip temperature sensor. The Bosch BMP085 digital pressure sensor 164 is a MEMs barometric pressure sensor surface-mounted on the VTI™ SCP1000 digital absolute pressure sensor circuit board 162, and wired as shown. The VIT™ SCP1000 circuit board 162 employs a CMOS interface ASIC (U1) with on-chip calibration memory, preset measuring modes and a LCP (Liquid Crystal Plastic) MID (Molded Interconnect Device) housing. It is the first known absolute pressure sensor available to use MEMS technology to give full 17-bit resolution. Under ideal conditions, this sensor 164 can detect the pressure difference within a 9 cm column of air. The device is intended for barometric pressure measurement and altimeter applications for 30 kPa to 120 kPa and −20 C to 70 C measuring ranges.

The pressure output data from circuit board 162 is communicated to microcontroller 72 using an SPI interface at a high speed data read (1.7 Hz). At very low power Microcontroller 72 converts the pressure measurement to an indication of height above sea level, according to a standard pressure-altitude relationship, and this provides sub-meter altitude (meters/feet) accuracy on the order of just a few feet, beginning at flight altitude to ground level.

Figure 5:
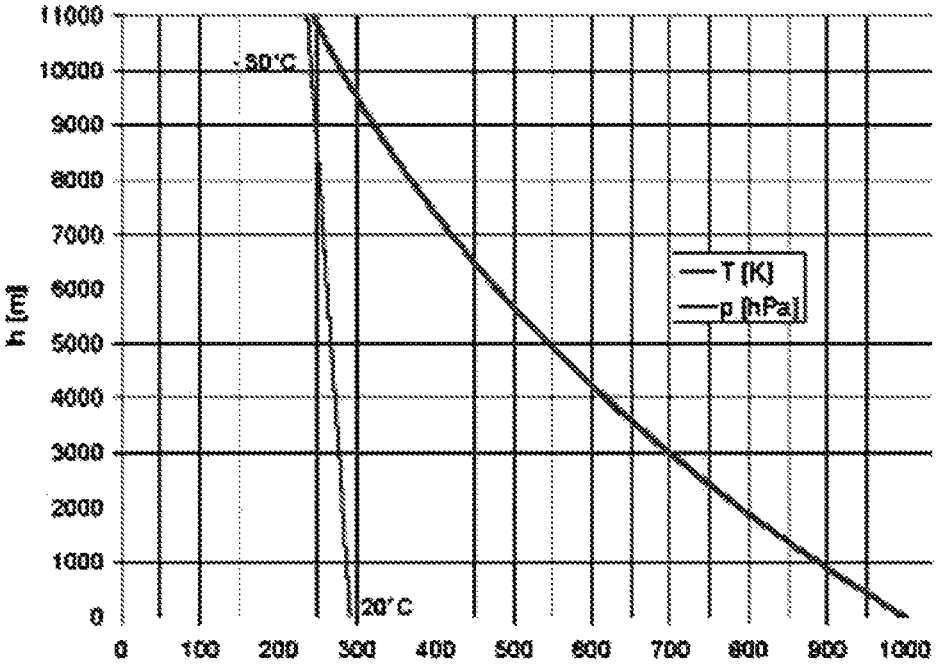
FIG. 5 illustrates the pressure-altitude relationship used in the logarithmic equation derived from the graph shown in FIG. 4, and employed by the programmable controller 60 of FIG. 2 in deciding when to detonate.

The pressure-altitude relationship is a logarithmic equation derived from the graph shown in FIG. 5, which plots the relationship between pressure temperature and altitude.

The accuracy of the absolute air pressure from VTI's SCP1000 sensor (1.5 Pa resolution), combined with a relatively high data output frequency (1.7 Hz at 17-bit resolution) yields a stationery accuracy on the order of 3.5 inches and a few feet falling along the vertical air column.

The barometric altimeter 68 may be replaced by a laser rangefinder 73 that emits a laser beam to determine the distance to the ground by measuring the time taken by the pulse to be reflected off the ground and returned to the laser rangefinder 73. There are commercially-available laser rangefinders that have been adapted for aircraft altitude measurement, such as the Acuity™ AR3000 laser which is currently used for piloted helicopters and UAV's. This particular rangefinder has a high sampling rate which is necessary during free fall of the present device. Where a laser rangefinder 73 is used in place of barometric altimeter 68, the rangefinder 73 must be positioned remotely on the bomb 10 with a clear and stable downward line of sight. This is best accomplished by mounting rangefinder 73 inside the cone tip 40 with the laser optics facing outward. Rangefinder 73 may be mounted internally or externally of cone 40 on a gimbal or other suitable pivoted support to maintain a constant line of sight despite the pitching and rolling of the bomb 10. The absolute distance output data from laser rangefinder 73 is communicated to microcontroller 72 and no conversion is required, again providing altitude (meters/feet) accuracy on the order of a couple meters, beginning at flight altitude to ground level.

Should barometric altimeter 68 or laser rangefinder 73 fail, the GPS module 67 preferably employs a SiRF III chipset with accuracy of +/−10 feet, which receiver determines altitude by trilateration with four or more satellites. In an airborne vehicle, altitude determined using autonomous GPS is not as precise or accurate enough to supersede the pressure/laser altimeter, and so it is herein used as a redundant failsafe backup, and also to provide a GPS locator 69 recovery function.

One skilled in the art should understand that other mechanisms may be suitable for determining detonation altitude, and may be substituted for the primary or redundant detonation means in accordance with the present invention. The GPS locator 69 may be a conventional tracking transmitter with input for accepting GPS coordinates from GPS module 67, and capable of emitting those coordinates encoded into a distress radio beacon. A variety of conventional ELTs or EPIRBs are commercially available to aid in the detection and location of boats, aircraft, and people in distress.

In use, with the component parts disassembled. The explosive charge 24 is packed first, the tail section 30 (if hardwired) is wired by connecting wires 62 at connector 64, and the tail section 30 is screwed onto canister 20. The canister 20 filled with the desired wet or dry fire suppressant/retardant, again preferably, a very fine powder of monoammonium phosphate ($(NH_4)H_2PO_4$), though sodium bicarbonate ($NaHCO_3$), or potassium bicarbonate ($KHCO_3$) will also suffice. All of these powders can coat and smother fires, and will work to put out class A and B fires (normal fires and flammable liquids), as well as class C fires involving flammable gases. They are safe for use on electrical fires as well. Moreover, the powders are non-toxic, non-conductive and environmentally safe. Monoammonium phosphate (MAP) or Williams Fire ABC powder are especially preferred. MAP is an ammonium salt of a phosphoric acid containing nitrogen and phosphorus. The MAP granules tend to be of a spherical from which disperse well in air. Moreover, MAP is an excellent water-soluble fertilizer, and is effective on all soils for forest restoration. The nose cone 40 is applied and the programmable controller 60 is set to explode at some predetermined altitude (preferably 2-200 feet above the tree line or about 100-400 feet total). The bomb 10 is dropped from an aircraft and the programmable controller 60 will automatically detonate the explosive charge 24 at that precise altitude +/−10 feet. If the higher-accuracy barometric altimeter 68 or laser rangefinder 73 fails, the GPS-based altimeter serves as a failsafe backup for detonation. The controller 60 analyzes the two datasets and if the barometric altimeter 68 or laser rangefinder 73 dataset stops expectedly or shows any incongruous pattern, the controller 60 will rely on the GPS locator 69 instead. Either way, the bomb 10 is detonated to spread its contents, and a parachute 70 is simultaneously deployed if recovery is desired. Toward that same end the GPS locator 69 continues to emit coordinates into a distress radio beacon so that the bomb 10 can be located.

It should be apparent that the above-described device offers a relatively inexpensive and easy to use, and yet highly reliable and consistent barometric/GPS-activated fire-extinguishing bomb that can be pre-programmed to explode a 100-200 feet above the tree line. The bomb will detonate with extreme accuracy at the proper altitude, reliably due to its redundant failsafe detonation system, coating the ground below with a uniform coating of dry environmentally-friendly fire-retardant powder having no toxicity and having fertilizer properties. Moreover, the core components of the bomb are either biodegradable or can be readily retrieved and reused after each activation, thereby increasing both economy and reducing environmental concerns.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed:

1. A fire-extinguishing bomb, comprising:

a containment canister comprising a cylindrical wall formed of a rupturable material;

an explosive charge inside said containment canister;

an internal framework for reinforcing said containment canister, said internal framework including a central receptacle for supporting said explosive charge centrally inside said containment canister, and a plurality of elongate struts, each said strut ending from said containment canister wall to said central receptacle, said plurality of elongate struts collectively affixing said central receptacle centrally in the containment canister;

a nose cone capping said containment canister at one end;

a tail section capping said containment canister at another end;

a payload of fire suppressant/retardant material filling said containment canister around said internal framework;

a first altitude sensor for transmitting a first data stream;

a programmable controller for allowing programming of a predetermined altitude for detonating said explosive charge, said programmable controller being in communication with said first altitude sensor for receiving said first data stream therefrom and selectively detonating said explosive charge upon attaining said predetermined altitude.

2. The fire-extinguishing bomb according to claim 1, wherein said first altitude sensor is a barometric altitude sensor.

3. The fire-extinguishing bomb according to claim 1, wherein said first altitude sensor is a laser rangefinder.

4. The fire-extinguishing bomb according to claim 3, wherein said laser rangefinder is mounted in said nose cone.

5. The fire-extinguishing bomb according to claim 4, wherein said laser rangefinder is mounted on a gimbal in said nose cone.

6. The fire-extinguishing bomb according to claim 1, further comprising a second attitude sensor for transmitting a second data stream.

7. The fire-extinguishing bomb according to claim 6, wherein said second altitude sensor is a GPS position sensor.

8. The fire-extinguishing bomb according to claim 7, wherein when said first data stream is incongruous, said programmable controller selectively detonates said explosive charge at said predetermined altitude based on said second data stream.

9. The fire-extinguishing bomb according to claim 7, wherein said GPS position sensor emits a locator signal from recovery of said fire extinguishing bomb.

10. The fire-extinguishing bomb according to claim 6, wherein said programmable controller is in communication with said first altitude sensor for receiving said first data stream, and said second altitude sensor for receiving said second data stream, and said programmable controller analyzes said first data stream for progressively decreasing altitude before selectively detonating said explosive charge.

11. The fire-extinguishing bomb according to claim 1, wherein said containment canister is cardboard.

12. The fire-extinguishing bomb according to claim 1, wherein said containment canister is plastic.

13. The fire-extinguishing bomb according to claim 12, wherein said plastic containment canister is formed with seams to facilitate rupturing.

14. A fire-extinguishing bomb, comprising:

a containment canister comprising a cylindrical wall formed of a rupturable material;

an explosive charge inside said containment canister;

an igniter attached to said explosive charge an internal framework for reinforcing said containment canister, said internal framework including a central holder for supporting said explosive charge and igniter centrally inside said containment canister, and a plurality of elongate struts, each said strut extending from said containment canister wall to said central holder, said plurality of elongate struts collectively affixing said central receptacle centrally in the containment canister;

a nose assembly capping said containment canister at one end;

a tail assembly capping said containment canister at another end, said tail assembly having a plurality of axially-oriented air foils;

a payload of fire suppressant/retardant material filling said containment canister around said internal framework;

a first altitude sensor for transmitting a first data stream;

a programmable controller for allowing programming of a predetermined altitude for detonating said explosive charge, said programmable controller being in communication with said first altitude sensor for receiving said first data stream therefrom and selectively detonating said explosive charge upon attaining said predetermined altitude.

15. The fire-extinguishing bomb according to claim 14, wherein said first altitude sensor is a barometric altitude sensor.

16. The fire-extinguishing bomb according to claim 14, wherein said first altitude sensor is a laser rangefinder.

17. The fire-extinguishing bomb according to claim 16, wherein said laser rangefinder is mounted in said nose cone.

18. The fire-extinguishing bomb according to claim 17, wherein said laser rangefinder is mounted on a gimbal in said nose cone.

19. The fire-extinguishing bomb according to claim 14, further comprising a second altitude sensor for transmitting a second data stream.

20. The fire-extinguishing bomb according to claim 19, wherein said second altitude sensor is a GPS position sensor.

21. The fire-extinguishing bomb according to claim 20, wherein said GPS position sensor emits a locator signal from recovery of said fire extinguishing bomb.

22. The fire-extinguishing bomb according to claim 21, further comprising a parachute.

23. The fire-extinguishing bomb according to claim 22, wherein said GPS position sensor emits a locator signal for recovery of said fire extinguishing bomb.

24. The fire-extinguishing bomb according to claim 19, wherein said programmable controller is in communication with said first altitude sensor for receiving said first data stream, and said second altitude sensor for receiving said second data stream, and said programmable controller analyzes said first data stream for sequential congruity before selectively detonating said explosive charge.

25. The fire-extinguishing bomb according to claim 24, wherein when said first data stream is incongruous, said programmable controller selectively detonates said explosive charge at said predetermined altitude based on said second data stream.

26. The fire-extinguishing bomb according to claim 14, wherein said containment canister is cardboard.

27. The fire-extinguishing bomb according to claim 26, wherein said containment canister comprises an internal waterproof laminate film and said payload of fire suppressant/retardant material comprises liquid.

28. The fire-extinguishing bomb according to claim 14, wherein said containment canister is plastic.

29. The fire-extinguishing bomb according to claim 28, wherein said plastic containment canister is scored along seams to facilitate rupturing.

30. The fire-extinguishing bomb according to claim 14, wherein said payload of fire suppressant/retardant material comprises powder.

* * * * *